US009232568B2

(12) United States Patent
Lee

(10) Patent No.: US 9,232,568 B2
(45) Date of Patent: Jan. 5, 2016

(54) WATERLESS DETECTION METHOD AND A WATERLESS DETECTION DEVICE OF A BOILER IRON AND AN IRON APPLIED WITH THE DEVICE THEREOF

(75) Inventor: Chihh-Wa Lee, Tainan (TW)

(73) Assignee: TSANN KUEN (ZHANG ZHOU) ENTERPRISE CO., LTD., Zhangzhou (CN)

( * ) Notice: Subject to any disclaimer, the term of this patent is extended or adjusted under 35 U.S.C. 154(b) by 340 days.

(21) Appl. No.: 13/814,805

(22) PCT Filed: Aug. 11, 2011

(86) PCT No.: PCT/CN2011/078239

§ 371 (c)(1),
(2), (4) Date: Feb. 7, 2013

(87) PCT Pub. No.: WO2012/019543

PCT Pub. Date: Feb. 16, 2012

(65) Prior Publication Data

US 2013/0126507 A1 May 23, 2013

(30) Foreign Application Priority Data

Aug. 11, 2010 (CN) ..... 2010 1 0251265

(51) Int. Cl.
*H05B 1/00* (2006.01)
*D06F 75/10* (2006.01)
*D06F 75/26* (2006.01)

(52) U.S. Cl.
CPC *H05B 1/00* (2013.01); *D06F 75/10* (2013.01); *D06F 75/26* (2013.01)

(58) Field of Classification Search
CPC ..... H05B 1/00; H05B 1/02; H05B 1/0252; H05B 1/0255; H05B 1/0283; H05B 1/0288; H05B 1/0297; H05B 1/0269; D06F 75/10; D06F 75/26; D06F 75/06; D06F 75/14; D06F 75/16; D06F 75/18; D06F 79/00
See application file for complete search history.

(56) References Cited

U.S. PATENT DOCUMENTS

2009/0151206 A1* 6/2009 Cai et al. ..... 38/1 C

FOREIGN PATENT DOCUMENTS

| | | | |
|---|---|---|---|
| CN | 201121277 | Y | 9/2008 |
| CN | 101457466 | A | 6/2009 |
| DE | 4304532 | A1 | 8/1994 |
| EP | 0843039 | A1 | 5/1998 |

* cited by examiner

*Primary Examiner* — Shawntina Fuqua
(74) *Attorney, Agent, or Firm* — Rabin & Berdo, P.C.

(57) ABSTRACT

The present invention is provided with a waterless detection method and a waterless detection device of a boiler iron and an iron applied with the device thereof. The present invention is applied with a normal close thermostat of the constant temperature boiler and a control device, a signal line between the thermostat of the traditional boiler iron and the control device to send the off and on information of the thermostat to the control device. The control device can judge the presence of the water in the water tank according to the empiric value of the actual heating system, preventing the pump from damage due to empty pumped. Compared to the traditional iron with other hardware detection device, the present invention costs lower with simple manufactory. And It saves more space for other component of the iron as well.

10 Claims, 2 Drawing Sheets

WATERLESS DETECTION METHOD AND A WATERLESS DETECTION DEVICE OF A BOILER IRON AND AN IRON APPLIED WITH THE DEVICE THEREOF

FIELD OF THE INVENTION

The present invention relates to a waterless detection method and a waterless detection device, especially to a waterless detection method and a waterless detection device of a pump boiler of an iron.

BACKGROUND OF THE INVENTION

The traditional pump iron is disposed with a housing with a handle. The inside of housing is disposed with a water tank and a pump, a heating pan is disposed in the bottom of the boiler to heat the water to be steam. The housing is disposed with a switch. The pump is disposed to pump the water in the water tank to the boiler to generate steam. The way of the existing iron to generate steam is spray steam type, that is to say, the water in the water tank is dripping to the heating pan of the boiler by the pump to generate a small amount of steam, and the steam sprays out of the steam outlet hole of the boiler beside the heating pan. To avoid water boiled away, the water tank must have water, so a water detection device is required to detect the water in the water tank.

The existing water detection method is: 1. use a spring switch to cooperate with a magnet, put the floater with magnet in the water tank, the floater floats when there is water in the water tank, the spring switch detects the position change of the floater to detect the water. 2. put the metal probe in the water pipe, the resistance of the metal probe changes according to the presence of the water as the water detection basis.

However, above proposals are required at least a hardware architecture to detect the water, which enhances the cost of the iron.

SUMMARY OF THE INVENTION

The object of the present invention is to provide with a waterless detection method and a waterless detection device of a boiler iron to solve the problem of the existing technology. The present invention judges the presence of the water in the water tank according to the different temperature performance in different water presence.

The technical proposal of the present invention is as below:

The First Technical Proposal:

A waterless detection method of a boiler iron, the method is applied with a normal close thermostat of the constant temperature boiler and a control device, at least a signal line is connected between the thermostat of the boiler and the control device, the control device receives the off and on state information of the thermostat through the signal line, and judges the presence of the water in the water tank according to that whether the off time of the thermostat exceeds the preset value or not.

In another preferred embodiment, the control device includes a detection unit and a judgment unit, the detect unit detects the off and on state information of the thermostat, the judgment unit judges the presence of the water in the water tank of the boiler according to the off and on state information of the thermostat.

In another preferred embodiment, the off and on state information of the thermostat includes the frequency and duration of the off and on of the thermostat.

In another preferred embodiment, the waterless detection method of a boiler iron thereof includes steps as blow:

Step 1. the iron is situated in the waiting state without steam, then turn to the step 2;

Step 2. the control device receives the signal of the thermostat through the signal line to judge that whether the thermostat cuts off once; if not, turn to the step 1, if the thermostat cuts off once, turn to the step 3;

Step 3. the temperature of the heating pan is high enough to generate steam, then turn to the step 4;

Step 4. judge that whether the steam is required, if not, turn to step 3; if the steam is required, turn to the step 5;

Step 5. judge that whether the off time of the thermostat exceeds the preset value, if not, turn to the step 4; if the off time of the thermostat exceeds the preset value, the judgment result is that no water is in the water tank.

In another preferred embodiment, in the step 4, judge that whether the steam is required by detecting the steam button signal.

In another preferred embodiment, the preset value is 10 s to 120 s.

In another preferred embodiment, the better preset value is 30 s to 50 s.

The Second Technical Proposal:

A waterless detection device of a boiler iron, wherein the device is applied with a normal close thermostat of the constant temperature boiler and a control device, a signal line is connected between the thermostat of the boiler and the control device, the control device at least includes a detection unit and a judgment unit, the judgment unit judges that whether the thermostat is cut off once, if not, the judgment is that the iron is situated in the power on and waiting state, if the thermostat is cut off once, activate the detection unit;

The detection unit is disposed to detect that whether the off duration of the thermostat exceeds the preset value, if the off duration of the thermostat exceeds the preset value, the judgment is that no water is in the water tank.

The Third Technical Proposal:

An iron with a waterless detection device, wherein the iron is disposed with a waterless detection device, the device is applied with a normal close thermostat of the constant temperature boiler and a control device, a signal line is connected between the thermostat of the boiler and the control device, the control device at least includes a detection unit and a judgment unit, the judgment unit judges that whether the thermostat is cut off once, if not, the judgment is that the iron is situated in the power on and waiting state, if the thermostat is cut off once, activate the detection unit;

The detection unit is disposed to detect that whether the off duration of the thermostat exceeds the preset value, if the off duration of the thermostat exceeds the preset value, the judgment is that no water is in the water tank.

As know from above, the present invention is disposed with a signal line between the thermostat of the traditional boiler iron and the control device to send the off and on information of the thermostat to the control device. The control device can judge the presence of the water in the water tank according to the empiric value of the actual heating system, preventing the pump from damage due to empty pumped. Compared to the traditional iron with other hardware detection device, the present invention costs lower with simple manufactory. It saves more space for other component of the iron as well.

THE DETAILED DESCRIPTION OF THE EMBODIMENTS

Figure 1:
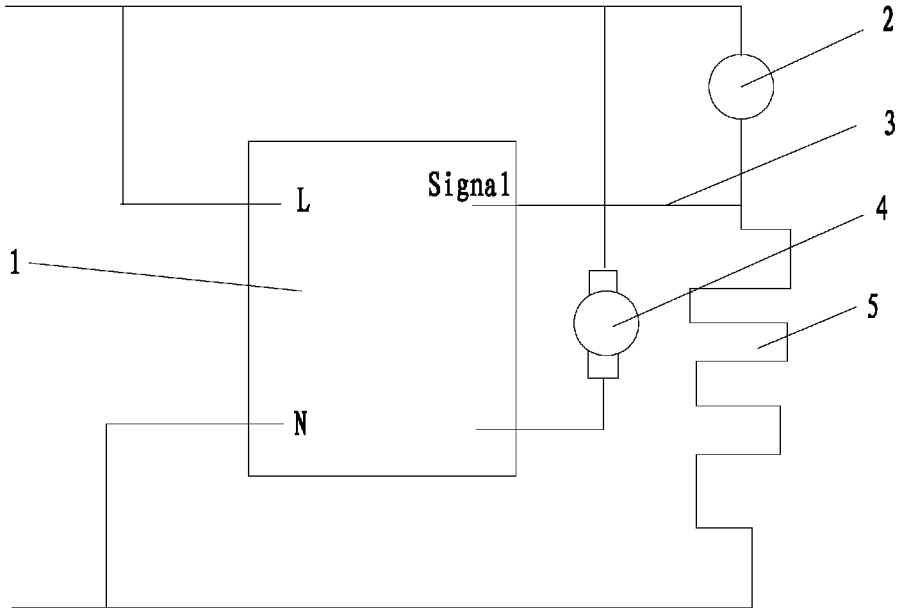
FIG. 1 illustrates the control circuit diagram of the embodiment of the present invention.
Figure 2:
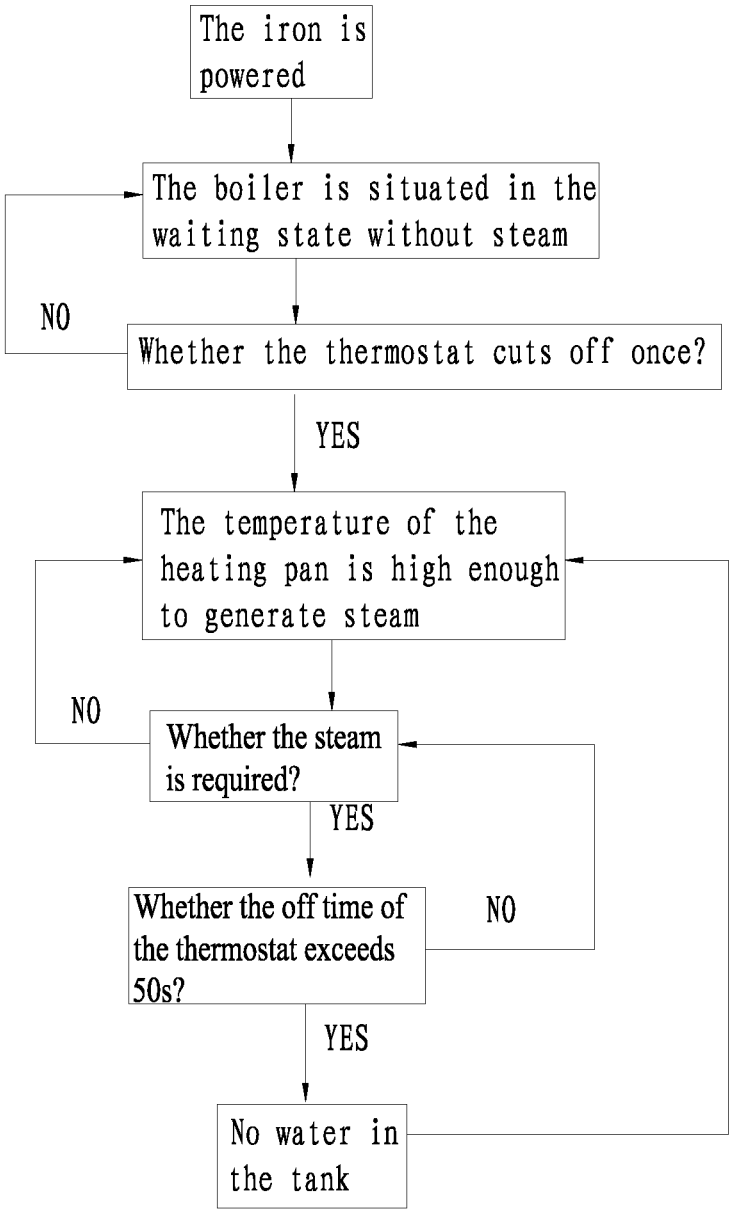
FIG. 2 illustrates the logic judge diagram of the embodiment of the present invention.

Refer to the FIG. 1 and FIG. 2. a waterless detect method of a boiler of a iron is applied with a normal close thermostat 2 of the constant temperature boiler and a control device 1, a signal line 3 is connected between the thermostat 2 of the boiler and the control device 1, the control device 1 includes a detection unit and a judgment unit, the detect unit detects the off and on state information of the thermostat, the judgment unit judges the presence of the water in the water tank of the boiler according to the off and on state information of the thermostat.

The method includes steps as blow:

Step 0. the iron is powered on to work;

Step 1. the boiler is situated in the waiting state without steam, then turn to the step 2;

Step 2. the control device receives the signal of the thermostat through the signal line to judge that whether the thermostat cuts off once; if not, turn to the step 1, if the thermostat cuts off once, turn to the step 3;

Step 3. the temperature of the heating pan is high enough to generate steam, then turn to the step 4;

Step 4. judge that whether the steam is required, if not, turn to step 3; if the steam is required, turn to the step 5;

Step 5. judge that whether the off time of the thermostat exceeds the preset value, if not, turn to the step 4; if the off time of the thermostat exceeds the preset value, the judgment result is that no water is in the water tank.

In the step 4, judge that whether the steam is required by detecting the steam button signal.

The work principle of the present invention is:

A signal line 3 is connected to the control device 1 from the port of the boiler thermostat 2, so the control device 1 can judge that whether the thermostat is on or off.

When the iron is powered on, the water in the water tank is dripping to the heating pan in the bottom of the boiler by the pump. As the thermostat 2 is normal on, the boiler is heated to a certain degree, such as over 100° C., so the steam the water vaporized is heated to be over 100° C. When the temperature of the boiler reached to the working temperature of the thermostat, the thermostat 2 automatically cuts off in the first time. Then the boiler is off to stop heating, the temperature decreases. When the temperature decreases to the working temperature of the thermostat, the thermostat is powered on, the boiler continues to heat. After several times of repeat, the temperature of the boiler is above 100° C. controlled by the thermostat, so once the control device 1 detects that the thermostat 2 has been off once through the signal line 3, it judges that the heating pan in the bottom of the boiler has been standby to outlet the steam.

The boiler is situated in a close environment, making the heat exchange weakly with the outside. If the water flows into the boiler, the vaporization will draw off a considerable quantity of heat, so it needs a period of time for boiler to return to working temperature. Correspondingly, the time scale of the on and off of the thermostat will change greatly.

In this embodiment, if no water is in the boiler, the on time of the thermostat is about 10 s and the off time is about 2 min; If there is water flowing to the boiler, the on time of the thermostat will extend to more than 30 s and the off time will shorten to less than 20 s.

From the above principle, if the water is pumped to the boiler and the thermostat of the boiler is cut off above 50 s, it can judge that no water is in the boiler and no water in the water tank either.

The precondition of the present invention is that the heating system must be a relative close system, so the heating exchange is simple. The vaporization of the water inside the system is the most important variation value to change the thermal balance.

A boiler iron is disposed with a waterless detection device, the device is applied with a normal close thermostat of the constant temperature boiler and a control device, a signal line is connected between the thermostat of the boiler and the control device, the control device includes a detection unit and a judgment unit, the judgment unit judges that whether the thermostat is cut off once, if not, the judgment is that the iron is situated in the power on and waiting state, if the thermostat is cut off once, activate the detection unit; The detection unit is disposed to detect that whether the off duration of the thermostat exceeds the preset value, if the off duration of the thermostat exceeds the preset value, the judgment is that no water is in the water tank.

In this embodiment, the control device detects and receives the signal of the thermostat and sends command to control the pump.

As figured in the FIG. 1, the waterless detection device includes a control device 1, a thermostat 2, a signal line 3, a pump 4 and a heating pan 5.

Those skilled in the art can design the detailed circuit to apply in the iron without creative labor, no further description here.

Although the present invention has been described with reference to the preferred embodiments thereof for carrying out the patent for invention, it is not limited to the idea of the present invention. And it is apparent to those skilled in the art that a variety of modifications and changes may be made without departing from the scope of the patent for invention which is intended to be defined by the appended claims.

INDUSTRIAL APPLICABILITY

The present invention is provided with a waterless detection method and a waterless detection device of a boiler iron and an iron applied with the device thereof, which is disposed with a signal line to send the off and on information of the thermostat to the control device. The control device can judge the presence of the water in the water tank according to the empiric value of the actual heating system, preventing the pump from damage due to empty pumped. The present invention costs lower with simple manufactory, and it also saves more space for other component of the iron.

What is claimed is:

1. A waterless detection method of a boiler iron, wherein the method is applied with a normal close thermostat of the constant temperature boiler and a control device, at least a signal line is connected between the thermostat of the boiler and the control device, the control device receives the off and on state information of the thermostat and judges the presence of the water in the water tank according to whether an off time of the thermostat exceeds a preset value or not.

2. A waterless detection method of a boiler iron according to the claim 1, wherein the control device includes a detection unit and a judgment unit, the detection unit detects the off and on state of the thermostat, the judgment unit judges the presence of the water in the water tank of the boiler according to the off and on state information of the thermostat.

3. A waterless detection method of a boiler iron according to the claim 1, wherein the off and on state information of the thermostat includes the frequency and duration of the off and on of the thermostat.

4. A waterless detection method of a boiler iron according to the claim 1, wherein the method includes steps as blow:

step 1. the iron is situated in the waiting state without steam, then turn to the step 2;

step 2. the control device receives the signal of the thermostat through the signal line to judge that whether the thermostat cuts off once; if not, turn to the step 1, if the thermostat cuts off once, turn to the step 3;

step 3. the temperature of the heating pan is high enough to generate steam, then turn to the step 4;

step 4. judge that whether the steam is required, if not, turn to step 3; if the steam is required, turn to the step 5;

step 5. judge that whether the off time of the thermostat exceeds the preset value, if not, turn to the step 4; if the off time of the thermostat exceeds the preset value, the judgment result is that no water is in the water tank.

5. A waterless detection method of a boiler iron according to the claim 4, wherein in the step 4, judge that whether the steam is required by detecting the steam button signal.

6. A waterless detection method of a boiler iron according to the claim 4, wherein the preset value is 10 s to 120 s.

7. A waterless detection method of a boiler iron according to the claim 4, wherein the preset value is 30 s to 50 s.

8. A waterless detection device of a boiler iron, wherein the device is applied with a normal close thermostat of the constant temperature boiler and a control device, a signal line is connected between the thermostat of the boiler and the control device, the control device includes a detection unit and a judgment unit, the judgment unit judges whether the thermostat is cut off once, if not, the judgment is that the iron is situated in the power on and waiting state, if the thermostat is cut off once, the detection unit is activated;

the detection unit is disposed to detect whether an off duration of the thermostat exceeds a preset value, and if the off duration of the thermostat exceeds the preset value, the judgment is that no water is in the water tank.

9. An iron with a waterless detection device, wherein the iron is disposed with a waterless detection device, the device is applied with a normal close thermostat of the constant temperature boiler and a control device, a signal line is connected between the thermostat of the boiler and the control device, the control device at least includes a detection unit and a judgment unit, the judgment unit judges whether the thermostat is cut off once, if not, the judgment is that the iron is situated in the power on and waiting state, if the thermostat is cut off once, the detection unit is activated;

the detection unit is disposed to detect whether an off duration of the thermostat exceeds a preset value, and if the off duration of the thermostat exceeds the preset value, the judgment is that no water is in the water tank.

10. A waterless detection method of a boiler iron according to the claim 2, wherein the off and on state information of the thermostat includes the frequency and duration of the off and on of the thermostat.

* * * * *